US012753468B2

(12) United States Patent
Vecchio et al.

(10) Patent No.: US 12,753,468 B2
(45) Date of Patent: Oct. 6, 2026

(54) COATING COMPOSITION COMPRISING CHROMIUM AND ALUMINUM AND COATINGS FORMED USING THE SAME

(71) Applicant: Oerlikon Metco (US) Inc., Westbury, NY (US)

(72) Inventors: James Nathaniel Vecchio, San Diego, CA (US); Justin Lee Cheney, Encinitas, CA (US); Naixie Zhou, San Diego, CA (US)

(73) Assignee: Oerlikon Metco (US) Inc., Westbury, NY (US)

( * ) Notice: Subject to any disclaimer, the term of this patent is extended or adjusted under 35 U.S.C. 154(b) by 502 days.

(21) Appl. No.: 18/547,055

(22) PCT Filed: Feb. 18, 2022

(86) PCT No.: PCT/US2022/070736
§ 371 (c)(1),
(2) Date: Aug. 18, 2023

(87) PCT Pub. No.: WO2022/178541
PCT Pub. Date: Aug. 25, 2022

(65) Prior Publication Data

US 2024/0133015 A1 Apr. 25, 2024
US 2024/0229215 A9 Jul. 11, 2024

Related U.S. Application Data

(60) Provisional application No. 63/151,934, filed on Feb. 22, 2021.

(51) Int. Cl.
*C23C 4/00* (2016.01)
*C22C 30/00* (2006.01)
(Continued)

(52) U.S. Cl.
CPC ..... *C22C 30/00* (2013.01); *C23C 4/02* (2013.01); *C23C 4/073* (2016.01)

(58) Field of Classification Search
CPC ..... C22C 30/00; C23C 4/073; C23C 4/02
(Continued)

(56) References Cited

U.S. PATENT DOCUMENTS 2,043,952 A 6/1936 Ffield
2,156,306 A 5/1939 Rapatz
(Continued)

FOREIGN PATENT DOCUMENTS

CN 86102537 9/1987
CN 1033292 6/1989
(Continued)

OTHER PUBLICATIONS

Al-Aqeeli et al.: "Formation of an amorphous phase and its crystallization in the immiscible Nb—Zr system by mechanical alloying," Journal of Applied Physics 114, 153512, 2013.
(Continued)

*Primary Examiner* — James E Mcdonough
(74) *Attorney, Agent, or Firm* — Knobbe, Martens, Olson & Bear, LLP

(57) ABSTRACT

This disclosure generally relates to coating compositions comprising chromium and aluminum and coatings formed using the same, and more particularly to bond coat compositions and coatings for use in various gas turbine applications. In one aspect, a material composition comprises M, Cr, and Al, wherein M is one or more of Ni, Co, and Fe. The material composition is configured to form a BCC ordered phase and a disordered metallic phase of either a BCC or FCC crystal structure.

20 Claims, 8 Drawing Sheets

P118-X5

(51) Int. Cl.
*C23C 4/02* (2006.01)
*C23C 4/073* (2016.01)

(58) Field of Classification Search
USPC ..... 106/1.05
See application file for complete search history.

(56) References Cited

U.S. PATENT DOCUMENTS 2,507,195 A 5/1950 Winearls
2,608,495 A 8/1952 Barry
2,873,187 A 2/1959 Dyrkaez et al.
2,936,229 A 5/1960 Shepard
3,024,137 A 3/1962 Witherell
3,113,021 A 12/1963 Witherell
3,181,970 A 5/1965 Witherell et al.
3,303,063 A 2/1967 Pietryka et al.
3,448,241 A 6/1969 Buckingham et al.
3,554,792 A 1/1971 Johnson
3,650,734 A 3/1972 Kantor et al.
3,663,214 A 5/1972 Moore
3,724,016 A 4/1973 Kumar et al.
3,819,364 A 6/1974 Frehn
3,843,359 A 10/1974 Fiene et al.
3,859,060 A 1/1975 Eiselstein et al.
3,942,954 A 3/1976 Frehn
3,975,612 A 8/1976 Nakazaki et al.
4,010,309 A 3/1977 Peterson
4,017,339 A 4/1977 Okuda et al.
4,042,383 A 8/1977 Petersen et al.
4,066,451 A 1/1978 Rudy
4,110,514 A 8/1978 Nicholson
4,214,145 A 7/1980 Zvanut et al.
4,235,630 A 11/1980 Babu
4,240,827 A 12/1980 Aihara
4,255,709 A 3/1981 Zatsepium et al.
4,277,108 A 7/1981 Wallace
4,285,725 A 8/1981 Gysel
4,297,135 A 10/1981 Giessen et al.
4,318,733 A 3/1982 Ray et al.
4,362,553 A 12/1982 Ray
4,365,994 A 12/1982 Ray
4,415,530 A 11/1983 Hunt
4,419,130 A 12/1983 Slaughter
4,576,653 A 3/1986 Ray
4,596,282 A 6/1986 Maddy et al.
4,606,977 A 8/1986 Dickson et al.
4,635,701 A 1/1987 Sare et al.
4,638,847 A 1/1987 Day
4,639,576 A 1/1987 Shoemaker
4,666,797 A 5/1987 Newman et al.
4,673,550 A 6/1987 Dallaire et al.
4,762,681 A 8/1988 Tassen et al.
4,803,045 A 2/1989 Ohriner et al.
4,806,394 A 2/1989 Steine
4,818,307 A 4/1989 Mori et al.
4,822,415 A 4/1989 Dorfman et al.
4,888,153 A 12/1989 Yabuki
4,919,728 A 4/1990 Kohl et al.
4,943,488 A 7/1990 Sung et al.
4,957,982 A 9/1990 Geddes
4,966,626 A 10/1990 Fujiki et al.
4,981,644 A 1/1991 Chang
5,094,812 A 3/1992 Dulmaine et al.
5,252,149 A 10/1993 Dolman
5,280,726 A 1/1994 Urbanic et al.
5,306,358 A 4/1994 Lai et al.
5,375,759 A 12/1994 Hiraishi et al.
5,424,101 A 6/1995 Atkins
5,495,837 A 3/1996 Mitsuhashi
5,567,251 A 10/1996 Peker et al.
5,570,636 A 11/1996 Lewis
5,618,451 A 4/1997 Ni
5,820,939 A 10/1998 Popoola et al.
5,837,326 A 11/1998 Dallaire
5,843,243 A 12/1998 Kawasaki et al.
5,858,558 A 1/1999 Zhao et al.
5,861,605 A 1/1999 Ogawa et al.
5,907,017 A 5/1999 Ober et al.
5,911,949 A 6/1999 Ninomiya et al.
5,935,350 A 8/1999 Raghu et al.
5,942,289 A 8/1999 Jackson
5,976,704 A 11/1999 McCune
5,988,302 A 11/1999 Sreshta et al.
6,071,324 A 6/2000 Laul et al.
6,117,493 A 9/2000 North
6,171,222 B1 1/2001 Lakeland et al.
6,210,635 B1 4/2001 Jackson et al.
6,232,000 B1 5/2001 Singh et al.
6,238,843 B1 5/2001 Ray
6,306,524 B1 10/2001 Spitsberg et al.
6,326,582 B1 12/2001 North
6,331,688 B1 12/2001 Hallén et al.
6,332,936 B1 12/2001 Hajaligo et al.
6,375,895 B1 4/2002 Daemen
6,398,103 B2 6/2002 Hasz et al.
6,441,334 B1 8/2002 Aida et al.
6,582,126 B2 6/2003 North
6,608,286 B2 8/2003 Jiang
6,669,790 B1 12/2003 Gundlach et al.
6,689,234 B2 2/2004 Branagan
6,702,905 B1 3/2004 Qiao et al.
6,702,906 B2 3/2004 Ogawa et al.
6,750,430 B2 6/2004 Kelly
7,052,561 B2 5/2006 Lu et al.
7,219,727 B2 5/2007 Slack et al.
7,285,151 B2 10/2007 Sjodin et al.
7,361,411 B2 4/2008 Daemen et al.
7,491,910 B2 2/2009 Kapoor et al.
7,507,305 B2 3/2009 Kawasaki et al.
7,553,382 B2 6/2009 Branagan et al.
7,569,286 B2 8/2009 Daemen et al.
7,754,152 B2 7/2010 Riebel et al.
7,776,451 B2 8/2010 Jiang et al.
7,935,198 B2 5/2011 Branagan et al.
8,070,894 B2 12/2011 Branagan
8,097,095 B2 1/2012 Branagan
8,153,935 B2 4/2012 Jang et al.
8,187,529 B2 5/2012 Powell
8,187,725 B2 5/2012 Kiser et al.
8,268,453 B2 9/2012 Dallaire
8,474,541 B2 7/2013 Branagan et al.
8,562,759 B2 10/2013 Cheney et al.
8,562,760 B2 10/2013 Cheney et al.
8,640,941 B2 2/2014 Cheney
8,647,449 B2 2/2014 Cheney et al.
8,658,934 B2 2/2014 Branagan et al.
8,662,143 B1 3/2014 Foster
8,669,491 B2 3/2014 Menon et al.
8,702,835 B2 4/2014 Yu et al.
8,703,046 B2 4/2014 Hanejko et al.
8,704,134 B2 4/2014 Branagan et al.
8,777,090 B2 7/2014 Miller et al.
8,801,872 B2 8/2014 Wright et al.
8,808,471 B2 8/2014 Wright et al.
8,858,675 B2 10/2014 Larsson
8,870,997 B2 10/2014 Klekovkin et al.
8,901,022 B2 12/2014 Francy et al.
8,911,662 B2 12/2014 Larsson
8,920,938 B2 12/2014 Hesse et al.
8,961,869 B2 2/2015 Kapoor et al.
8,973,806 B2 3/2015 Cheney
8,992,659 B2 3/2015 Larsson et al.
9,051,635 B2 6/2015 Jou
9,095,932 B2 8/2015 Miller et al.
9,121,295 B2 * 9/2015 Menuey ..... C23C 18/1254
9,145,598 B2 9/2015 Oshchepkov
9,174,293 B2 11/2015 Meyer
9,193,011 B2 11/2015 Mars et al.
9,233,419 B2 1/2016 Gries
9,255,309 B2 2/2016 Aimone
9,309,585 B2 4/2016 Cheney et al.
9,314,848 B2 4/2016 Larsson
9,340,855 B2 5/2016 Schade et al.
9,394,591 B2 7/2016 Deodeshmukh et al.

(56) References Cited

U.S. PATENT DOCUMENTS 9,399,907 B2 7/2016 Mo et al.
9,469,890 B2 10/2016 Bengtsson
9,540,711 B2 1/2017 Fifield
9,580,773 B2 2/2017 Aimone et al.
9,631,262 B2 4/2017 Wright et al.
9,724,786 B2 8/2017 Postle et al.
9,725,793 B2 8/2017 Aimone et al.
9,738,959 B2 8/2017 Cheney et al.
9,745,648 B2 8/2017 Olserius et al.
9,802,387 B2 10/2017 Cheney
9,815,148 B2 11/2017 Postle
9,816,164 B2 11/2017 Larsson et al.
9,821,372 B2 11/2017 Gries
9,834,829 B1 12/2017 Aimone et al.
9,845,520 B2 12/2017 Wright et al.
9,856,546 B2 1/2018 Fischer et al.
9,869,132 B2 1/2018 Wyble et al.
9,879,333 B2 1/2018 Gerk et al.
9,908,816 B2 3/2018 Champion et al.
9,914,987 B2 3/2018 Snyder et al.
9,919,358 B2 3/2018 Gries
9,951,413 B2 4/2018 Billieres
9,957,590 B2 5/2018 Mars et al.
9,957,592 B2 5/2018 Aimone et al.
9,970,091 B2 5/2018 Crook et al.
9,994,935 B2 6/2018 Wolverton et al.
10,100,388 B2 10/2018 Cheney
10,105,796 B2 10/2018 Eibl
10,125,412 B2 11/2018 Kaner et al.
10,173,290 B2 1/2019 Cheney
10,252,919 B2 4/2019 Billieres et al.
10,329,647 B2 6/2019 Cheney
RE47,529 E 7/2019 Johnson
10,351,921 B2 7/2019 Snyder et al.
10,351,922 B2 7/2019 Snyder et al.
10,351,938 B2 7/2019 Schade et al.
10,358,699 B2 7/2019 Srivastava et al.
10,358,701 B2 7/2019 Reed et al.
10,370,740 B2 8/2019 Reed et al.
10,384,313 B2 8/2019 Persson
10,400,314 B2 9/2019 Aimone et al.
10,458,006 B2 10/2019 Bengtsson
10,465,267 B2 11/2019 Cheney
10,465,268 B2 11/2019 Bergman
10,465,269 B2 11/2019 Cheney
10,471,503 B2 11/2019 Wright et al.
10,513,758 B2 12/2019 Mars
10,519,529 B2 12/2019 Wright et al.
10,550,460 B2 2/2020 Nilsson et al.
10,577,680 B2 3/2020 Srivastava et al.
10,597,757 B2 3/2020 Gong et al.
10,702,918 B2 7/2020 Hu
10,702,924 B2 7/2020 Szabo et al.
10,711,329 B2 7/2020 Wright et al.
10,731,236 B2 8/2020 Kaner et al.
10,745,782 B2 8/2020 Wolverton et al.
10,851,444 B2 12/2020 Vecchio et al.
10,851,565 B1 12/2020 Krueger
10,872,682 B2 12/2020 Reed et al.
10,934,608 B2 3/2021 Gu
10,941,473 B2 3/2021 Snyder
10,954,588 B2 3/2021 Cheney
11,001,912 B2 5/2021 Aimone et al.
11,033,998 B2 6/2021 Kavanaugh et al.
11,085,102 B2 8/2021 Cheney
11,111,912 B2 9/2021 Cheney
11,114,226 B2 9/2021 Jayaraman et al.
11,118,247 B2 9/2021 Gong et al.
11,124,429 B2 9/2021 Gore et al.
11,130,205 B2 9/2021 Cheney
11,174,538 B2 11/2021 Kaner et al.
11,261,506 B2 3/2022 Xu et al.
11,279,996 B2 3/2022 Cheney et al.
11,325,189 B2 5/2022 Imano et al.
11,326,239 B2 5/2022 Cao et al.
11,353,957 B2 6/2022 Border
11,359,268 B2 6/2022 Cao et al.
11,370,198 B2 6/2022 Maroli et al.
11,389,872 B2 7/2022 Stawovy et al.
11,401,582 B2 8/2022 Shibayama et al.
11,401,585 B2 8/2022 Gong et al.
11,401,592 B2 8/2022 Wei
11,414,728 B2 8/2022 Wang et al.
11,453,939 B2 9/2022 Pike
11,499,208 B2 11/2022 Wang et al.
11,499,212 B2 11/2022 Lu et al.
11,505,841 B2 11/2022 Tast et al.
11,505,849 B2 11/2022 Hericher et al.
11,566,313 B2 1/2023 Ota et al.
11,613,795 B2 3/2023 Wang et al.
11,655,528 B2 5/2023 Nymann
11,667,535 B2 6/2023 Turner et al.
11,667,993 B2 6/2023 Hericher et al.
11,685,979 B2 6/2023 Larsson et al.
11,701,730 B2 7/2023 Keegan et al.
11,702,724 B2 7/2023 Crook et al.
2001/0019781 A1 9/2001 Hasz
2002/0054972 A1 5/2002 Charpentier et al.
2002/0098298 A1 7/2002 Bolton et al.
2002/0148533 A1 10/2002 Kim et al.
2002/0159914 A1 10/2002 Yeh
2003/0013171 A1 1/2003 Yang et al.
2004/0001966 A1 1/2004 Subramanian
2004/0062677 A1 4/2004 Chabenat et al.
2004/0079742 A1 4/2004 Kelly
2004/0115086 A1 6/2004 Chabenat et al.
2004/0206726 A1 10/2004 Daemen et al.
2005/0031892 A1 2/2005 Mazumder
2005/0047952 A1 3/2005 Coleman
2005/0109431 A1 5/2005 Kernan et al.
2005/0139294 A1 6/2005 Kim et al.
2005/0164016 A1 7/2005 Branagan et al.
2006/0063020 A1 3/2006 Barbezat
2006/0093752 A1 5/2006 Darolia et al.
2006/0163217 A1 7/2006 Jiang
2006/0191606 A1 8/2006 Ogawa et al.
2006/0260583 A1 11/2006 Abi-Akar et al.
2007/0026159 A1 2/2007 Deem
2007/0029295 A1 2/2007 Branagan
2007/0090167 A1 4/2007 Arjakine et al.
2007/0125458 A1 6/2007 Kawasaki et al.
2007/0187369 A1 8/2007 Menon et al.
2007/0219053 A1 9/2007 Barufka et al.
2007/0253856 A1 11/2007 Vecchio et al.
2007/0284018 A1 12/2007 Hamano et al.
2008/0001115 A1 1/2008 Qiao et al.
2008/0031769 A1 2/2008 Yeh
2008/0083391 A1 4/2008 Sawada
2008/0149397 A1 6/2008 Overstreet
2008/0163786 A1* 7/2008 Feng ..... C22C 30/00 106/1.21
2008/0199684 A1 8/2008 Apte et al.
2008/0241580 A1 10/2008 Kiser et al.
2008/0241584 A1 10/2008 Daemen et al.
2008/0253918 A1 10/2008 Liang
2009/0017328 A1 1/2009 Katoh et al.
2009/0075057 A1 3/2009 Kulkarni
2009/0075101 A1 3/2009 Kulkarni et al.
2009/0123765 A1 5/2009 Branagan
2009/0252636 A1 10/2009 Christopherson, Jr. et al.
2009/0258250 A1 10/2009 Daemen et al.
2009/0285715 A1 11/2009 Arjakine et al.
2010/0009089 A1 1/2010 Junod et al.
2010/0028706 A1 2/2010 Hornschu et al.
2010/0044348 A1 2/2010 Buchmann
2010/0047622 A1 2/2010 Fischer et al.
2010/0055495 A1 3/2010 Sjodin
2010/0101780 A1 4/2010 Ballew et al.
2010/0132408 A1 6/2010 Billieres
2010/0136361 A1 6/2010 Osuki et al.
2010/0155236 A1 6/2010 Lee et al.
2010/0159136 A1 6/2010 Lee et al.
2010/0166594 A1 7/2010 Hirata et al.
2010/0189588 A1 7/2010 Kawatsu et al.

(56) References Cited

U.S. PATENT DOCUMENTS

2010/0192476 A1 8/2010 Theisen et al.
2010/0258217 A1 10/2010 Kuehmann
2011/0004069 A1 1/2011 Ochs et al.
2011/0031222 A1 2/2011 Branagan et al.
2011/0048587 A1 3/2011 Vecchio et al.
2011/0064963 A1 3/2011 Cheney et al.
2011/0139761 A1 6/2011 Sugahara et al.
2011/0142713 A1 6/2011 Kawasaki et al.
2011/0162612 A1 7/2011 Qiao et al.
2011/0171485 A1 7/2011 Kawamoto et al.
2011/0220415 A1 9/2011 Jin et al.
2012/0055903 A1 3/2012 Izutani et al.
2012/0100390 A1 4/2012 Kuroda
2012/0103456 A1 5/2012 Smith et al.
2012/0156020 A1 6/2012 Kottilingam et al.
2012/0160363 A1 6/2012 Jin et al.
2012/0258273 A1 10/2012 Churchill et al.
2012/0288400 A1 11/2012 Hirata et al.
2013/0039800 A1 2/2013 Dolman
2013/0094900 A1 4/2013 Folkmann et al.
2013/0108502 A1 5/2013 Bei
2013/0167965 A1 7/2013 Cheney et al.
2013/0171367 A1 7/2013 Kusinski et al.
2013/0174612 A1 7/2013 Linnot et al.
2013/0216722 A1 8/2013 Kusinski et al.
2013/0220523 A1 8/2013 Cheney
2013/0224516 A1 8/2013 Kusinski et al.
2013/0260177 A1 10/2013 Wallin et al.
2013/0266798 A1 10/2013 Cheney
2013/0266820 A1 10/2013 Kusinski et al.
2013/0294962 A1 11/2013 Wallin et al.
2014/0024509 A1 1/2014 Gerschefske
2014/0044587 A1 2/2014 Crook et al.
2014/0044617 A1 2/2014 Dreisinger
2014/0060707 A1 3/2014 Wright et al.
2014/0066851 A1 3/2014 Cheney, II
2014/0116575 A1 5/2014 Cheney et al.
2014/0131338 A1 5/2014 Postle
2014/0190594 A1 7/2014 Branagan et al.
2014/0219859 A1 8/2014 Cheney
2014/0234154 A1 8/2014 Cheney et al.
2014/0248509 A1 9/2014 Cheney et al.
2014/0263248 A1 9/2014 Postle
2014/0272388 A1 9/2014 Knight et al.
2014/0295194 A1 10/2014 Yoshitaka et al.
2014/0322064 A1 10/2014 Gerk et al.
2014/0356223 A1 12/2014 Nilsson et al.
2015/0004337 A1 1/2015 Zimmermann et al.
2015/0075681 A1 3/2015 Wright et al.
2015/0086413 A1 3/2015 Wolverton et al.
2015/0106035 A1 4/2015 Vecchio et al.
2015/0114525 A1 4/2015 Valls Anglés
2015/0118098 A1 4/2015 Valls
2015/0122552 A1 5/2015 Wang et al.
2015/0152994 A1 6/2015 Bondil et al.
2015/0252631 A1 9/2015 Miller
2015/0267283 A1 9/2015 Dolman
2015/0275341 A1 10/2015 Cheney
2015/0284817 A1 10/2015 Snyder et al.
2015/0284829 A1 10/2015 Cheney
2015/0307968 A1 10/2015 Mars et al.
2015/0328680 A1 11/2015 Tuffile
2015/0367454 A1 12/2015 Cheney
2016/0001368 A1 1/2016 Gries et al.
2016/0002752 A1 1/2016 Srivastava et al.
2016/0002764 A1 1/2016 Gries et al.
2016/0017463 A1 1/2016 Cheney
2016/0024628 A1 1/2016 Cheney
2016/0040262 A1 2/2016 Snyder et al.
2016/0083830 A1 3/2016 Cheney
2016/0114392 A1 4/2016 Berg et al.
2016/0138144 A1 5/2016 Olsérius
2016/0144463 A1 5/2016 Hellsten et al.
2016/0195216 A1 7/2016 Bondil et al.
2016/0201169 A1 7/2016 Vecchio
2016/0201170 A1 7/2016 Vecchio
2016/0215374 A1 7/2016 Schade et al.
2016/0222490 A1 8/2016 Wright et al.
2016/0243616 A1 8/2016 Gries
2016/0258044 A1 9/2016 Litström et al.
2016/0271736 A1 9/2016 Han et al.
2016/0289001 A1 10/2016 Shibata et al.
2016/0289798 A1 10/2016 Deodeshmukh et al.
2016/0289799 A1 10/2016 Crook et al.
2016/0289803 A1 10/2016 Cheney
2016/0329139 A1 11/2016 Jayaraman
2016/0376686 A1 12/2016 Jou
2017/0009324 A1 1/2017 Crook et al.
2017/0014865 A1 1/2017 Kusinski et al.
2017/0022588 A1 1/2017 Tang et al.
2017/0044646 A1 2/2017 Gong et al.
2017/0145547 A1 5/2017 Saal et al.
2017/0253950 A1 9/2017 Shinohara
2017/0275740 A1 9/2017 Bergman
2018/0016664 A1 1/2018 Hu
2018/0021894 A1 1/2018 Persoon et al.
2018/0066343 A1 3/2018 Bengtsson
2018/0066345 A1 3/2018 Cheney et al.
2018/0094343 A1 4/2018 Gerk et al.
2018/0099877 A1 4/2018 Chang et al.
2018/0135143 A1 5/2018 Snyder et al.
2018/0195156 A1 7/2018 Reed et al.
2018/0216212 A1 8/2018 Reed et al.
2018/0230016 A1 8/2018 Kaner et al.
2018/0230578 A1 8/2018 Srivastava et al.
2018/0258515 A1 9/2018 Jin
2018/0265949 A1 9/2018 Wolverton et al.
2018/0272423 A1 9/2018 Hu
2019/0017154 A1 1/2019 Kaner et al.
2019/0024217 A1 1/2019 Yolton
2019/0055860 A1 2/2019 Jones
2019/0071318 A1 3/2019 Kaner et al.
2019/0084039 A1 3/2019 Hu
2019/0177820 A1 6/2019 Larsson
2019/0234151 A1 8/2019 Olsen et al.
2019/0300374 A1 10/2019 Shevchenko et al.
2019/0309399 A1 10/2019 Badwe
2019/0323107 A1 10/2019 Srivastava et al.
2019/0368014 A1 12/2019 Liimatainen
2019/0376165 A1 12/2019 Wen
2020/0001367 A1 1/2020 Duffy et al.
2020/0005975 A1 1/2020 Jayaraman et al.
2020/0048743 A1 2/2020 Gong et al.
2020/0063238 A1 2/2020 Yolton
2020/0063239 A1 2/2020 Xu et al.
2020/0078860 A1 3/2020 Wright et al.
2020/0149141 A1 5/2020 Wu et al.
2020/0172998 A1 6/2020 Crudden et al.
2020/0189918 A1 6/2020 Saeuberlich et al.
2020/0316718 A1 10/2020 Smathers
2020/0325561 A1 10/2020 Kaner
2020/0385845 A1 12/2020 Gong
2021/0040585 A1 2/2021 Alabort
2021/0062305 A1 3/2021 Fang
2021/0164081 A1 6/2021 Eibl
2021/0180157 A1 6/2021 Bracci
2021/0180162 A1 6/2021 Vecchio
2021/0180170 A1 6/2021 Pike
2021/0197524 A1 7/2021 Maroli et al.
2021/0222275 A1 7/2021 Saboo et al.
2021/0246537 A1 8/2021 Maroli et al.
2021/0254202 A1 8/2021 Gong et al.
2021/0262050 A1 8/2021 Oshchepkov et al.
2021/0286079 A1 9/2021 Vecchio
2021/0332465 A1 10/2021 Behera et al.
2021/0387920 A1 12/2021 Bouttes et al.
2021/0402475 A1 12/2021 Taneike et al.
2022/0025492 A1 1/2022 Schade et al.
2022/0041449 A1 2/2022 Larsson et al.
2022/0081745 A1 3/2022 Komai et al.
2022/0165463 A1 5/2022 Vidarsson et al.
2022/0219231 A1 7/2022 Eibl
2022/0220583 A1 7/2022 Ota et al.
2022/0220584 A1 7/2022 Wang et al.

(56) References Cited

U.S. PATENT DOCUMENTS

| | | | |
|---|---|---|---|
| 2022/0274168 | A1 | 9/2022 | Sobu |
| 2022/0404035 | A1 | 12/2022 | Gattei |
| 2023/0043638 | A1 | 2/2023 | Frankel et al. |
| 2023/0070692 | A1 | 3/2023 | Ota et al. |
| 2023/0091911 | A1 | 3/2023 | Maroli et al. |
| 2023/0125609 | A1 | 4/2023 | Schade et al. |
| 2023/0134452 | A1 | 5/2023 | Saboo et al. |
| 2023/0175101 | A1 | 6/2023 | Shinzawa et al. |
| 2023/0193439 | A1 | 6/2023 | Forsik et al. |
| 2023/0235420 | A1 | 7/2023 | Kesti et al. |
| 2023/0235425 | A1 | 7/2023 | Kesti et al. |

FOREIGN PATENT DOCUMENTS

| | | | |
|---|---|---|---|
| CN | 1225629 | C | 11/2005 |
| CN | 101016603 | | 8/2007 |
| CN | 101948994 | | 1/2011 |
| CN | 101994076 | | 3/2011 |
| CN | 102233490 | A | 11/2011 |
| CN | 102286702 | | 12/2011 |
| CN | 102357750 | A | 2/2012 |
| CN | 102936724 | | 2/2013 |
| CN | 103628017 | | 3/2014 |
| CN | 103785967 | | 5/2014 |
| CN | 104233179 | | 12/2014 |
| CN | 104625473 | | 5/2015 |
| CN | 104694840 | | 6/2015 |
| CN | 104805391 | | 7/2015 |
| CN | 105057913 | | 11/2015 |
| CN | 105483539 | | 4/2016 |
| CN | 106119838 | | 11/2016 |
| CN | 108607983 | | 10/2018 |
| DE | 27 54 437 | | 7/1979 |
| DE | 33 20 513 | | 12/1983 |
| DE | 42 02 828 | | 8/1993 |
| DE | 4411296 | | 7/1995 |
| DE | 10 320 397 | A1 | 12/2004 |
| DE | 10329912 | | 6/2005 |
| EP | 0 346 293 | | 12/1989 |
| EP | 0 365 884 | | 5/1990 |
| EP | 0 774 528 | | 5/1997 |
| EP | 0 740 591 | | 3/1999 |
| EP | 1 077 268 | | 2/2001 |
| EP | 0 939 139 | | 10/2001 |
| EP | 1 270 755 | | 1/2003 |
| EP | 1 279 748 | | 1/2003 |
| EP | 1 279 749 | | 1/2003 |
| EP | 1 120 472 | | 7/2003 |
| EP | 1 477 579 | | 11/2004 |
| EP | 1 361 288 | | 9/2006 |
| EP | 1 721 999 | | 11/2006 |
| EP | 1 857 204 | | 11/2007 |
| EP | 1 694 876 | | 1/2008 |
| EP | 1 953 252 | | 8/2008 |
| EP | 2 050 533 | | 4/2009 |
| EP | 2 305 415 | | 4/2011 |
| EP | 2 388 345 | | 11/2011 |
| EP | 2 628 825 | | 8/2013 |
| EP | 2 639 323 | | 9/2013 |
| EP | 2 660 342 | | 11/2013 |
| EP | 2 072 627 | | 4/2014 |
| EP | 2 730 355 | | 5/2014 |
| EP | 2 743 361 | | 6/2014 |
| EP | 2 104 753 | | 7/2014 |
| EP | 2 777 869 | | 9/2014 |
| EP | 2 778 247 | | 9/2014 |
| EP | 2 873 747 | | 5/2015 |
| EP | 2 563 942 | | 10/2015 |
| EP | 2 064 359 | | 4/2016 |
| EP | 3 034 211 | | 6/2016 |
| EP | 3 034 637 | B1 | 6/2016 |
| EP | 2 235 225 | | 10/2016 |
| EP | 3 093 858 | | 11/2016 |
| EP | 2 659 014 | | 4/2017 |
| EP | 3 156 155 | | 4/2017 |
| EP | 2 147 445 | | 5/2017 |
| EP | 2 252 419 | | 6/2017 |
| EP | 2 265 559 | | 6/2017 |
| EP | 2 329 507 | | 6/2017 |
| EP | 2 285 996 | | 8/2017 |
| EP | 3 211 108 | | 8/2017 |
| EP | 1 700 319 | | 10/2017 |
| EP | 2 207 907 | | 12/2017 |
| EP | 2 788 136 | | 1/2018 |
| EP | 2 414 554 | B1 | 2/2018 |
| EP | 3 145 660 | | 4/2018 |
| EP | 2 432 908 | B1 | 5/2018 |
| EP | 2 181 199 | | 8/2018 |
| EP | 2 477 784 | | 8/2018 |
| EP | 2 695 171 | | 8/2018 |
| EP | 3 354 758 | | 8/2018 |
| EP | 1 799 380 | | 9/2018 |
| EP | 3 266 892 | | 10/2018 |
| EP | 3 444 452 | | 2/2019 |
| EP | 2 265 739 | | 6/2019 |
| EP | 3 259 095 | | 6/2019 |
| EP | 1 844 172 | | 7/2019 |
| EP | 3 517 642 | | 7/2019 |
| EP | 3 115 472 | | 10/2019 |
| EP | 3 552 740 | | 10/2019 |
| EP | 2 155 921 | | 11/2019 |
| EP | 3 350 354 | | 2/2020 |
| EP | 3 354 764 | | 3/2020 |
| EP | 3 149 216 | | 4/2020 |
| EP | 2 403 966 | B1 | 5/2020 |
| EP | 3 362 210 | | 5/2020 |
| EP | 3 134 558 | | 7/2020 |
| EP | 3 514 253 | | 10/2020 |
| EP | 3 333 275 | | 11/2020 |
| EP | 3 653 736 | | 12/2020 |
| EP | 3 411 169 | | 1/2021 |
| EP | 1 848 836 | B1 | 4/2021 |
| EP | 3 822 007 | | 5/2021 |
| EP | 2 671 669 | | 6/2021 |
| EP | 3 991 879 | | 5/2022 |
| EP | 4 116 444 | | 1/2023 |
| EP | 4 116 445 | | 1/2023 |
| EP | 4 180 225 | | 5/2023 |
| EP | 4 180 544 | | 5/2023 |
| FR | 2055735 | | 4/1971 |
| FR | 2218797 | | 9/1974 |
| GB | 465999 | | 5/1937 |
| GB | 956740 | | 4/1964 |
| GB | 1073621 | | 6/1967 |
| GB | 2153846 | A | 8/1985 |
| GB | 2273109 | | 6/1994 |
| GB | 2546809 | | 5/2018 |
| GB | 2579580 | | 7/2020 |
| GB | 2567492 | | 9/2020 |
| GB | 2584654 | | 12/2020 |
| GB | 2584905 | | 12/2020 |
| IN | MUMNP-2003-00842 | | 4/2005 |
| JP | 43-019745 | | 8/1968 |
| JP | 45-026214 | | 10/1970 |
| JP | 47-1685 | | 1/1972 |
| JP | 49-056839 | | 6/1974 |
| JP | 58-132393 | | 8/1983 |
| JP | 59-16951 | | 1/1984 |
| JP | 59-16952 | | 1/1984 |
| JP | 59-150692 | | 8/1984 |
| JP | 60-133996 | | 7/1985 |
| JP | 6031897 | B1 | 7/1985 |
| JP | 61-283489 | | 12/1986 |
| JP | 63-026205 | | 2/1988 |
| JP | 63-42357 | | 2/1988 |
| JP | 63-65056 | | 3/1988 |
| JP | 63-089643 | | 4/1988 |
| JP | 63-213628 | | 9/1988 |
| JP | 03-60895 | | 3/1991 |
| JP | 03-87327 | | 4/1991 |
| JP | 03-133593 | | 6/1991 |
| JP | 03-248799 | | 11/1991 |
| JP | 04-237592 | | 8/1992 |
| JP | 04-246142 | | 9/1992 |

(56) References Cited

FOREIGN PATENT DOCUMENTS

| | | |
|---|---|---|
| JP | 04-358046 | 12/1992 |
| JP | 07-179997 | 7/1995 |
| JP | 07-268524 | 10/1995 |
| JP | 08-134570 | 5/1996 |
| JP | 08-174272 | 7/1996 |
| JP | 09-95755 | 4/1997 |
| JP | 09-108887 | 4/1997 |
| JP | 2001-066130 | 3/2001 |
| JP | 2001-303233 | 10/2001 |
| JP | 2002-060907 | 2/2002 |
| JP | 2002-241919 | 8/2002 |
| JP | 2003-205352 | 7/2003 |
| JP | 2004-149924 | 5/2004 |
| JP | 2005-042152 | 2/2005 |
| JP | 2005-290406 | 10/2005 |
| JP | 2007-154284 | 6/2007 |
| JP | 2008-246523 | 10/2008 |
| JP | 2008-261329 | 10/2008 |
| JP | 2009-154183 | 7/2009 |
| JP | 2010-138440 | 6/2010 |
| JP | 2010-138491 | 6/2010 |
| JP | 2012-000616 | 1/2012 |
| JP | 2012-055899 | 3/2012 |
| JP | 2014-047388 | 3/2014 |
| JP | 2015-016497 | 1/2015 |
| JP | 2015-083715 | 4/2015 |
| JP | 2015-526596 | 9/2015 |
| KR | 2002 0019296 | 3/2002 |
| KR | 10-0935816 B1 | 1/2010 |
| SU | 1706398 | 1/1992 |
| TW | 200806801 A | 2/2008 |
| WO | WO 84/000385 | 2/1984 |
| WO | WO 84/004760 | 12/1984 |
| WO | WO 95/004628 | 2/1995 |
| WO | WO 03/018856 | 3/2003 |
| WO | WO 06/080978 | 8/2006 |
| WO | WO 06/086350 | 8/2006 |
| WO | WO 07/120194 | 10/2007 |
| WO | WO 08/042330 | 4/2008 |
| WO | WO 08/060226 | 5/2008 |
| WO | WO 08/082353 | 7/2008 |
| WO | WO 08/105788 | 9/2008 |
| WO | WO 08/153499 | 12/2008 |
| WO | WO 09/085000 | 7/2009 |
| WO | WO 10/044740 | 4/2010 |
| WO | WO 10/046224 | 4/2010 |
| WO | WO 10/074634 | 7/2010 |
| WO | WO 10/134886 | 11/2010 |
| WO | WO 11/005403 | 1/2011 |
| WO | WO 11/021751 | 2/2011 |
| WO | WO 11/071054 | 6/2011 |
| WO | WO 11/084213 | 7/2011 |
| WO | WO 11/091479 | 8/2011 |
| WO | WO 11/152774 | 12/2011 |
| WO | WO 11/158706 | 12/2011 |
| WO | WO 12/021186 | 2/2012 |
| WO | WO 12/022874 | 2/2012 |
| WO | WO 12/112844 | 8/2012 |
| WO | WO 12/162226 | 11/2012 |
| WO | WO 13/049056 | 4/2013 |
| WO | WO 13/055652 | 4/2013 |
| WO | WO 13/060839 | 5/2013 |
| WO | WO 13/102650 | 7/2013 |
| WO | WO 13/126134 | 8/2013 |
| WO | WO 13/152306 | 10/2013 |
| WO | WO 13/167580 | 11/2013 |
| WO | WO 13/167628 | 11/2013 |
| WO | WO 13/185174 | 12/2013 |
| WO | WO 14/001544 | 1/2014 |
| WO | WO 14/023646 | 2/2014 |
| WO | WO 14/070006 | 5/2014 |
| WO | WO 14/081491 | 5/2014 |
| WO | WO 14/083544 | 6/2014 |
| WO | WO 14/085319 | 6/2014 |
| WO | WO 14/090922 | 6/2014 |
| WO | WO 14/114714 | 7/2014 |
| WO | WO 14/114715 | 7/2014 |
| WO | WO 14/187867 | 11/2014 |
| WO | WO 14/197088 | 12/2014 |
| WO | WO 14/201239 | 12/2014 |
| WO | WO 14/202488 | 12/2014 |
| WO | WO 15/028358 | 3/2015 |
| WO | WO 15/049309 | 4/2015 |
| WO | WO 15/075122 | 5/2015 |
| WO | WO 15/183955 | 12/2015 |
| WO | WO 16/003520 | 1/2016 |
| WO | WO 16/010599 | 1/2016 |
| WO | WO 16/041977 | 3/2016 |
| WO | WO 16/099390 | 6/2016 |
| WO | WO 16/124532 | 8/2016 |
| WO | WO 16/131702 | 8/2016 |
| WO | WO 17/046517 | 3/2017 |
| WO | WO 17/059026 | 4/2017 |
| WO | WO 17/063923 | 4/2017 |
| WO | WO 17/091743 | 6/2017 |
| WO | WO 17/132286 | 8/2017 |
| WO | WO 17/132322 | 8/2017 |
| WO | WO 17/134039 | 8/2017 |
| WO | WO 17/157835 | 9/2017 |
| WO | WO 17/162499 | 9/2017 |
| WO | WO 17/186468 | 11/2017 |
| WO | WO 17/200797 | 11/2017 |
| WO | WO 18/015547 | 1/2018 |
| WO | WO 18/021409 | 2/2018 |
| WO | WO 18/050474 | 3/2018 |
| WO | WO 18/065614 | 4/2018 |
| WO | WO 18/04179 | 6/2018 |
| WO | WO 18/114845 | 6/2018 |
| WO | WO 18/138247 | 8/2018 |
| WO | WO 18/138270 | 8/2018 |
| WO | WO 18/232618 | 12/2018 |
| WO | WO 19/021015 | 1/2019 |
| WO | WO 19/043219 | 3/2019 |
| WO | WO 19/047587 | 3/2019 |
| WO | WO 19/108596 | 6/2019 |
| WO | WO 19/145196 | 8/2019 |
| WO | WO 19/166749 | 9/2019 |
| WO | WO 19/197376 | 10/2019 |
| WO | WO 19/215450 | 11/2019 |
| WO | WO 20/007652 | 1/2020 |
| WO | WO 20/043718 | 3/2020 |
| WO | WO 20/053518 | 3/2020 |
| WO | WO 20/065296 | 4/2020 |
| WO | WO 20/065297 | 4/2020 |
| WO | WO 20/074241 | 4/2020 |
| WO | WO 20/115478 | 6/2020 |
| WO | WO 20/201437 | 10/2020 |
| WO | WO 20/201438 | 10/2020 |
| WO | WO 21/089851 | 5/2021 |
| WO | WO 21/217512 | 11/2021 |
| WO | WO 21/219564 | 11/2021 |
| WO | WO 21/231285 | 11/2021 |
| WO | WO 21/247981 | 12/2021 |
| WO | WO 22/113466 | 6/2022 |
| WO | WO 22/149539 | 7/2022 |
| WO | WO 22/223835 | 10/2022 |
| WO | WO 23/091193 | 5/2023 |

OTHER PUBLICATIONS

Audouard, et al., Mar. 26-31, 2000, Corrosion Performance and Field Experience With Super Duplex and Super Austenitic Stainless Steels in FGD Systems, Corrosion 2000, 8 pp.

Azo Materials, "Stainless Steel—Grade 420," Oct. 23, 2001, <https://www.azom.com/article.aspx?ArticleID=972>, accessed Aug. 15, 2017.

Branagan, et al.: Developing extreme hardness (>15GPa) in iron based nanocomposites, Composites Part A: Applied Science and Manufacturing, Elsevier Science Publishers B.V., Amsterdam, NL, vol. 33, No. 6, Jun. 1, 2002, pp. 855-859.

Chen et al.: "Characterization of Microstructure and Mechanical Properties of High Chromium Cast Irons Using SEM and Nanoindentation," JMEPEG 2015 (published online Oct. 30, 2014), vol. 24(1), pp. 98-105.

(56) References Cited

OTHER PUBLICATIONS

Cheney, et al.: "Development of quaternary Fe-based bulk metallic glasses," Materials Science and Engineering, vol. 492, No. 1-2, Sep. 25, 2008, pp. 230-235.
Cheney: Modeling the Glass Forming Ability of Metals. A Dissertation submitted in partial satisfaction of the Requirements for the degree of Doctor of Philosophy. University of California, San Diego. Dec. 2007.
C—Mo Phase Diagram [online], [retrieved on Jan. 27, 2015]. Retrieved from the Internet: <URL:http://factsage.cn/fact/documentation/SGTE/C-Mo.jpg.
C—Nb Phase Diagram [online], [retrieved on Jan. 27, 2015]. Retrieved from the Internet: <URL:http://www.crct.polymtl.ca/fact/documentation/BINARY/C-Nb.jpg.
Cr—C Phase Diagram [online], [retrieved on Jan. 27, 2015]. Retrieved from the Internet: http://www.azom.com/work/3ud2quvLOU9g4VBMjVEh_files/image002.gif.
Crucible Industries LLC, Jun. 3, 2010, Crucible CPM S90V® data sheet, retrieved from the internet Mar. 14, 2019, https://www.crucible.com/PDFs/DataSheets2010/dsS90v1%202010.pdf, 2 pp.
Davis, Jr, ed. Dec. 1994, Stainless steels. ASM International, Materials Park, OH, p. 447.
Fujiki et al., 1988, The sintering phenomena and heat-treated properties of carbides and borides precipitated p/m alloys made of H.S.S. powder, Japan Society of Powder and Powder Metallurgy, 35(3):119-123.
Gorni, Oct. 9, 2003, Austenite transformation temperatures: ferrite start and finish, in Steel Forming and Heath Treating Handbook, pp. 26-43.
Iron-Carbon (Fe—C) Phase diagram [online], [retrieved on Jan. 27, 2014]. Retrieved from the internet: <URL:http://www.calphad.com/iron-carbon.html>.
Khalifa, et al.: "Effect of Mo—Fe substitution on glass forming ability, thermal stability, and hardness of Fe—C—B—Mo—Cr—W bulk amorphous allows," Materials Science and Engineering, vol. 490, No. 1-2, Aug. 25, 2008, pp. 221-228.
Kumashiro et al., May 31, 1980, The vickers micro-hardness of nonstoichiometric niobium carbide and vanadium carbide single crystals up to 1500c, Journal of Materials Science, 15(5):1321-1324.
Kushner et al., 1992, Thermal Spray Coatings, in Blau (ed) ASM Handbook, vol. 18, Friction, Lubrication, and Wear Technology, pp. 829-833.
Kutsova, Nov. 9, 2015, The influence of alloying elements on structure formation, phase composition and properties of chromium-manganese iron in the cast state, Metallurgical and Mining Industry, 1084.
Lemkey et al., 1981, The quaternary system Fe—Cr—Mn—C and aligned ferrous superalloys, MRS Online Proceedings Library, 12:31.
Li et al., Feb. 28, 2000, Temperature dependence of the hardness of single-phase cementite films prepared by an electron-shower PVD method, Journal of the Japan Institute of Metals and Materials, 64(2):134-140.
Liu et al., Jan. 14, 2000, Measurement of austenite-to-ferrite transformation temperature after multi-pass deformation of steels, Materials Science and Engineering A, 194(1):L15-L18.
Miracle, D.B.: The efficient cluster packing model—An atomic structural model for metallic glasses, Acta Materialia vol. 54, Issue 16, Sep. 2006, pp. 4317-4336.
Miyoshi et al., Apr. 25, 1965, High temperature hardness of WC, TiC, TaC, NbC and their mixed carbides, Journal of the Japan Society of Powder and Powder Metallurgy, 12(2):78-84.
Ohmura, Dec. 2003, Evaluation of temper softening behavior of Fe—C binary martensitic steels by nanoindentation, Scripta Materialia, 49(12):1157-1162.
Senkov et al., Jun. 23, 2010, Refractory high-entropy alloys, Intermetallics, 18:1758-1765.
Teng: "Processing, Microstructures, and Properties of Aluminide-Strengthened Ferritic Steels," The University of Tennessee, Knoxville, Dec. 2011.
Tillack, et al.: "Selection of Nickel, Nickel-Copper, Nickel-Chromium, and Nickel-Chromium-Iron Allows", ASM Handbook, Welding, Brazing and Soldering, vol. 6,Dec. 1, 1993 (Dec. 1, 1993) pp. 586-592, XP008097120, p. 589.
Titanium-Boron (TiB) Phase Diagram [online], [retrieved on Jan. 27, 2015]. Retrieved from the internet:<URL:http://www.calphad.com/titaniumboron.html>.
Tucker , 2013, Introduction to Thermal Spray Technology, ASM Handbook, vol. 5A, pp. 3-9.
Wang et al., Jul. 2014, Effect of molybdenum, manganese and tungsten contents on the corrosion behavior and hardness of iron-based metallic glasses, Materials and Corrosion, 65(7):733-741.
Wank et al., 2007, Behavior of thermally sprayed wear protective coatings exposed to different abrasive wear conditions in comparison to hard chromium platings, 7 pp.
Wayne, 1985, Iron-rich low-coast superalloys, PhD dissertation, University of Connecticut, 184 pp.
Yamamoto et al., 2014, Influence of Mo and W on high temperature hardness of M7C3 carbide in high chromium white cast iron, Materials Transactions, 55(4):684-689.
Yano et al., Apr. 2011, Modification of NiAl intermetallic coatings processed by PTA with chromium carbides, ASTM International Journal, 8(4):190-204.
Yoo et al., Jun. 2006, The effect of boron on the wear behavior of iron-based hardfacing alloys for nuclear power plants valves, Journal of Nuclear Materials, 352:90-96.
Zhu et al., 2017, Microstructure and sliding wear performance of Cr7C3-(Ni,Cr)3(Al,Cr) coating deposited from Cr7C3 in situ formed atomized powder, J. Therm Spray Tech, 26:254-264.
International Search Report and Written Opinion re PCT Application No. PCT/US2022/070736, mailed Feb. 18, 2022.

* cited by examiner

The proximity is calculated using the dot product:

$$\text{proximity} = \cos\theta = \frac{A \bullet B}{|A|\,|B|}$$

Figure 1

Diamalloy 4700

P118-X11

P118-X11

COATING COMPOSITION COMPRISING CHROMIUM AND ALUMINUM AND COATINGS FORMED USING THE SAME

CROSS-REFERENCE TO RELATED APPLICATION

This application claims the benefit of priority to U.S. Provisional application No. 62/151,934, filed Feb. 22, 2021, entitled "MCRALY BONDCOAT ALLOYS," the content of which is incorporated by reference herein in its entirety.

BACKGROUND

Field

This disclosure generally relates to coating compositions comprising chromium and aluminum and coatings formed using the same, and more particularly to bond coat compositions and coatings for use in various gas turbine applications.

SUMMARY

Disclosed herein are embodiments of a thermal spray feedstock material, comprising, in weight percent (wt. %) nickel: 18-31; cobalt: 18-31; iron: 18-31; chromium: 16-27; and aluminum: 2-13. In other embodiments, the thermal spray feedstock material comprises, in weight percent: Ni: about 12.15-about 23.73, Co: about 23.34-about 48.78, Fe: about 11.56-about 22.58, Cr: about 5.03-about 21.03, and Al: about 8.84-about 16.75. In some embodiments, the feedstock material further comprises 0.25-1 wt. % yttrium.

In some embodiments, the feedstock material is configured to have, under equilibrium thermodynamic conditions, a first and second matrix proximity of 85% or higher. In some embodiments, the feedstock material, is configured to have under equilibrium thermodynamic conditions, a first and second matrix proximity of 90% or higher. In some embodiments, the feedstock material is configured to have, under equilibrium thermodynamic conditions, a first and second matrix proximity of 95% or higher.

In some embodiments, the feedstock material is configured to have, under equilibrium thermodynamic conditions, a B2 formation delta in a range of 0 K to 150 K. In some embodiments, the feedstock material is configured to have, under equilibrium thermodynamic conditions, a B2 formation delta in a range of 25 K to 80 K. In some embodiments, the feedstock material is configured, under thermodynamic equilibrium conditions, to comprise 40% or more of a B2 ordered phase. In some embodiments, the feedstock material is configured, under thermodynamic equilibrium conditions, to comprise 45% or more of a B2 ordered phase. In some embodiments, the feedstock material is configured, under thermodynamic equilibrium conditions, to comprise 50% or more of a B2 ordered phase. In some embodiments, the feedstock material is configured, under thermodynamic equilibrium conditions, to comprise a B2 ordered phase at any percentage in a range defined by any of the above percentages.

In some embodiments, the feedstock material is configured, under thermodynamic equilibrium conditions, to comprise 5 mole % or greater of oxidation resistant phases. In some embodiments, the feedstock material is configured, under thermodynamic equilibrium conditions, to comprise 10 mole % or greater of oxidation resistant phases. In some embodiments, the feedstock material is configured, under thermodynamic equilibrium conditions, to comprise 20 mole % or greater of oxidation resistant phases. In some embodiments, the feedstock material is configured, under thermodynamic equilibrium conditions, to comprise oxidation resistant phases at a mole % in a range defined by any of the above percentages. In some embodiments, the oxidation resistant phases comprise carbides such as chromium carbides.

Also disclosed herein are embodiments of a coating formed from the feedstock material disclosed herein. The coating can be a thermal spray coating and/or a bond coating. It will be understood that, in various embodiments described herein, any of material characteristics of one of a feedstock material and a coating, including the compositions and/or thermodynamic properties, can also be present in the other of the feedstock and the coating. described herein.

In some embodiments, the coating comprises fine scale phases of at least 85 mole % or greater. In some embodiments, the coating comprises fine scale phases of at least 90 mole % or greater. In some embodiments, the coating comprises fine scale phases of at least 95 mole % or greater. In some embodiments, the coating comprises fine scale phases at a mole % in a range defined by any of the above percentages.

In some embodiments, the coating comprises at least 40 mole % of a B2 ordered phase. In some embodiments, the coating comprises at least 45 mole % of a B2 ordered phase. In some embodiments, the coating comprises at least 50 mole % of a B2 ordered phase. In some embodiments, the coating comprises a B2 ordered phase at a mole % in a range defined by any of the above percentages.

In some embodiments, the coating comprise 5 volume % or greater of oxidation resistant phases. In some embodiments, the coating comprise 15 volume % or greater of oxidation resistant phases. In some embodiments, the coating comprise 20 volume % or greater of oxidation resistant phases. In some embodiments, the oxidation resistant phases comprise chromium carbides. In some embodiments, the coating comprises oxidation resistant phases at a volume % in a range defined by any of the above percentages.

In some embodiments, the coating can exhibit greater than 270 cycles before failure during an FCT testing at 1150° C. In some embodiments, the coating can exhibit greater than 300 cycles before failure during an FCT testing at 1150° C. In some embodiments, the coating can exhibit greater than 330 cycles before failure during an FCT testing at 1150° C.

In some embodiments, the coating is applied on a Ni-based superalloy. In some embodiments, the coating can comprise a thermal barrier coating applied onto the coating. In some embodiments, a thermal spray coating comprises, in weight percent (wt. %): nickel: 18-31; cobalt: 18-31; iron: 18-31; chromium: 16-27; and aluminum: 2-13.

Also disclosed herein are embodiments of a method of forming a heat resistant coating comprising applying a bond coat layer unto a Ni-based superalloy, the bond coat layer comprising Ni: about 12.15-about 23.73, Co: about 23.34-about 48.78, Fe: about 11.56-about 22.58, Cr: about 5.03-about 21.03, and Al: about 8.84-about 16.75, and applying a thermal barrier coating onto the bond coat layer. In some embodiments, the method of forming comprises thermal spraying. In some embodiments, the bond coat layer further comprises 0.25-1 wt. % yttrium.

Disclosed herein are embodiments of a bond coat material comprising M, Cr, and Al, wherein M is one or more of Ni, Co, and Fe which under equilibrium thermodynamics will precipitate a BCC ordered phase from the liquid upon cooling followed by a disordered metallic of either BCC or FCC crystal structure, wherein the microstructure comprises a fine scale structure making up 85% or greater of the total microstructure as characterized by phases which are 100 nm in size or smaller when solidified from a liquid state at a rate of 20 degrees K/second or slower.

In some embodiments, the formation temperature of the BCC ordered phase and the disordered phase is 0-150 K. In some embodiments, the BCC ordered phase and the disordered metallic phase are compositionally similar as defined by a cosine similarity of greater than 85% when comparing the chemistries of both phases. In some embodiments, the BCC ordered phase comprises greater than 40% of the total microstructure. In some embodiments, the material thermodynamically forms an oxidation resistant phase at a mole fraction of 10% or greater. In some embodiments, the material forms an oxidation resistant phase which is chromium carbide at a mole fraction of 10% or greater. In some embodiments, the microstructure comprises a fine scale structure making up 85% or greater of the total microstructure as characterized by phases which are 100 nm in size or smaller when solidified from a liquid state at a rate of 20 degrees K/second or slower.

In some embodiments, the composition comprises in wt. %, Ni: 12.15-23.73 (or about 12.15-about 23.73), Co: 23.34-48.78 (or about 23.34-about 48.78), Fe: 11.56-22.58 (or about 11.56-about 22.58), Cr: 5.03-21.03 (or about 5.03-about 21.03), and Al: 8.84-16.75 (or about 8.84-about 16.75). In other embodiments, the composition comprises in wt %, nickel: 18-31; cobalt: 18-31; iron: 18-31; chromium: 16-27; and aluminum: 2-13.

In some embodiments, the composition comprises in wt. %, Ni: 20-22 (or about 20-about 22), Co: 21-23 (or about 21-about 23), Fe: 20-24.2 (or about 20-about 24.2), Cr: 26-30 (or about 26-about 30), C: 0.5-1 (or about 0.5-about 1), and Al: 6-8 (or about 6-about 8).

In some embodiments, the composition comprises yttrium from 0.1-1 wt. %.

Also disclosed herein are embodiments of a bond coat material comprising M, Cr, and Al, wherein M is one or more of Ni, Co, and Fe which under equilibrium thermodynamics will precipitate a BCC ordered phase from the liquid upon cooling followed by a disordered metallic of either BCC or FCC crystal structure.

Further disclosed herein are embodiments of a thermal spray feedstock material configured for high temperature use, the feedstock material comprising, in wt. %, Ni: about 18-about 31, Co: about 18-about 31, Fe: about 18-about 31, Cr: about 16-about 27, and Al: about 2-about 13.

Further disclosed herein are embodiments of a thermal spray feedstock material configured for high temperature use, the feedstock material comprising, in wt. %, Ni: about 21-about 28, Co: about 21-about 28, Fe: about 21-about 28, Cr: about 18-about 15, and Al: about 6-about 10.

BRIEF DESCRIPTION OF THE DRAWINGS

FIG. 1 illustrates a cosine similarity equation.

DETAILED DESCRIPTION

Figure 2:
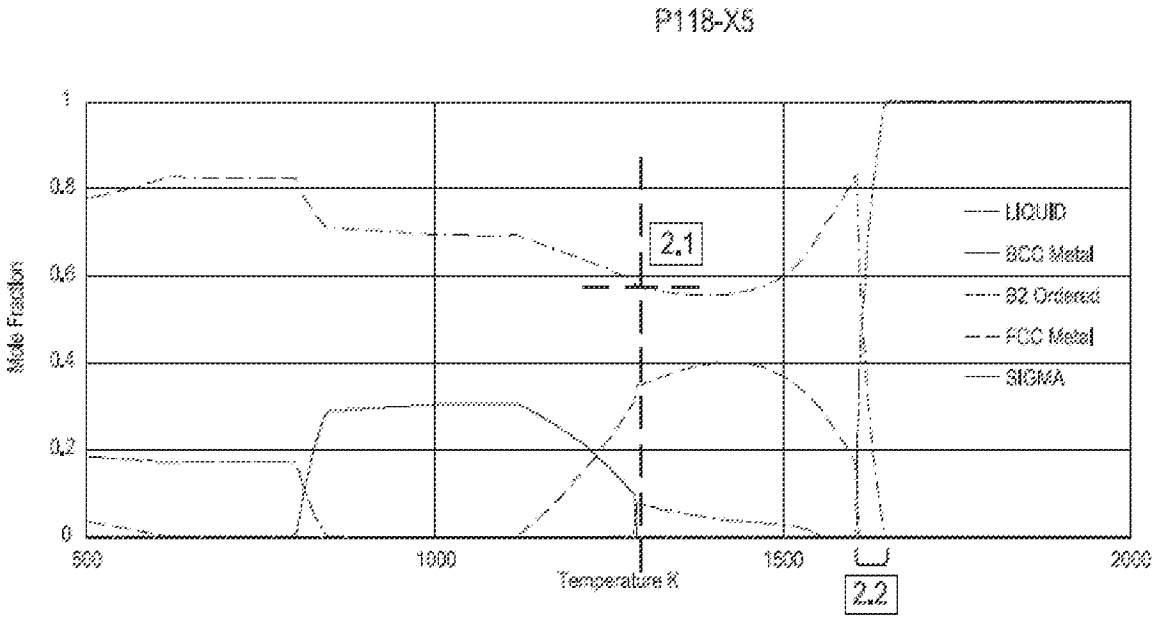
FIG. 2 illustrates an embodiment of a phase diagram for P118-X5.

MCrAlY alloys, which refer to some alloys comprising nickel, cobalt, iron, chromium and optionally yttrium, can be used to protect Ni-based superalloys from high temperature oxidation and corrosion, though the particular substrate type is not limiting, and are particularly useful in various gas turbine applications. For high temperature applications, such as at temperature of 900° C. or higher, a thermal barrier coating (TBC) can be applied to the top of the bond coat to reduce the effective surface temperature of Ni-based superalloys. Embodiments of the disclosure can be an intermediate coating between the superalloy and the TBC.

The TBC is applied on top of a superalloy to reduce the temperature at the substrate interface. However, the TBC tends to be quite porous so oxygen can still penetrate and attack the substrate. Advantageously, embodiments of the disclosed MCrAlY bond coat can be applied between the layers, and at elevated temperatures the bond coat can form an oxide layer on the surface. This oxide layer is a thermally grown oxide (TGO). This TGO layer can be very dense and may not react with oxygen. Accordingly, the TGO layer formed from a MCrAlY bond coat can prevent or reduce the amount of oxygen that reaches the substrate. At high temperatures though, the MCrAlY starts to form a thermally grown oxide (TGO) between itself and the TBC.

Although the TGO is useful for preventing further oxygen penetration, it can grow too thick, which may result in high internal stresses during thermal cycling which may ultimately cause spalling of the TBC and failure of the system. This disclosure describes embodiments of a new family of MCrAlYs that have shown increased cycle life as determined by furnace cycle testing.

As disclosed herein, the term alloy can refer to the chemical composition forming the powder, the powder itself, and the composition of the metal component formed by the heating and/or deposition of the powder.

In some embodiments, the material may be applied to a substrate, such as through thermal spray processing. In some embodiments, high velocity oxygen fuel spraying, atmospheric plasma spraying, or controlled atmospheric plasma spraying can be performed to apply the material to a substrate. In some embodiments, the material may be applied via welding or other methods, and the application procedure is not limiting.

Composition:

In some embodiments, various material compositions disclosed herein, including those of a thermal spray feedstock material, a thermal spray coating and a bond coat material, can include, in weight percent:

nickel (Ni): 12.15-23.73 (or about 12.15-about 23.73)
cobalt (Co): 23.34-48.78 (or about 23.34-about 48.78)
iron (Fe): 11.56-22.58 (or about 11.56-about 22.58)
chromium (Cr): 5.03-21.03 (or about 5.03-about 21.03)
aluminum (Al): 8.84-16.75 (or about 8.84-about 16.75)

In some embodiments, various material compositions disclosed herein, including those of a thermal spray feedstock material, a thermal spray coating and a bond coat material, can include:

Ni: 23.24-24.18 (or about 23.24-about 24.18)

Co: 36.75-38.84 (or about 36.75-about 38.84)
Cr: 21.42-29.34 (or about 21.42-about 29.34)
Al: 10.68-15.56 (or about 10.68-about 15.56)

In some embodiments, various material compositions disclosed herein, including those of a thermal spray feedstock material, a thermal spray coating and a bond coat material, can include:

Ni: 20-22 (or about 20-about 22)
Co: 21-23 (or about 21-about 23)
Fe: 20-24.2 (or about 20-about 24.2)
Cr: 26-30 (or about 26-about 30)
C: 0.5-1 (or about 0.5-about 1)
Al: 6-8 (or about 6-about 8)

In some embodiments, various material compositions disclosed herein, including those of a thermal spray feedstock material, a thermal spray coating and a bond coat material, can include:

Ni: 18-31 (or about 18-about 31)
Co: 18-31 (or about 18-about 31)
Fe: 18-31 (or about 18-about 31)
Cr: 16-27 (or about 16-about 27)
Al: 2-13 (or about 2-about 13)

In some embodiments, various material compositions disclosed herein, including those of a thermal spray feedstock material, a thermal spray coating and a bond coat material, can include:

Ni: 21-28 (or about 21-about 28)
Co: 21-28 (or about 21-about 28)
Fe: 21-28 (or about 21-about 28)
Cr: 18-25 (or about 18-about 25)
Al: 6-10 (or about 6-about 10)

In some embodiments, various material compositions disclosed herein, including those of a thermal spray feedstock material, a thermal spray coating and a bond coat material, can include:

M: Balance whereas M is a combination of nickel, cobalt, and iron
Cr: 10-50 (or about 10-about 50)
C: 0.5-3.5 (or about 0.5-about 3.5)
Al: 5-14 (or about 0.5-about 3.5)

In some embodiments, any or all of the above ranges can be defined by the following relationship:

$6\% < Al + 0.25*Cr < 16\%$ about $6\% < Al + 0.25*Cr <$ about $16\%$

Embodiments of the disclosure can form an alloy which forms chromium carbide precipitates in a gamma matrix.

In some embodiments, any or all of the above ranges can be defined by the following relationship:

$15\% < Al + 0.25*Cr < 21\%$ about $15\% < Al + 0.25*Cr <$ about $21\%$

In some embodiments, alloys can have a lower Al content which can therefore form a gamma matrix. A gamma matrix is generally a continuous matrix with a face-centered cubic (FCC) nickel based austenitic phase that usually contains a high percentage of solid solution elements. With higher Al content, the alloy may form a gamma and beta matrix. A beta matrix generally has a body centered cubic structure and is often but not always found at high temperature. Advantageously, carbides can be added into the microstructure to help improve thermal and resistance properties.

In some embodiments, the MCrAlY material can form an alloy of chromium carbide precipitates in a matrix comprising a combination of gamma and beta whereas the gamma/beta ratio is 0.5 to 2.

In some embodiments, anywhere from 0.1-1 (or about 0.1-about 1) weight percent of yttrium can be added to any of the above compositions described. The yttrium can help the TGO layer adhere to the MCrAlY, and can reduce the chance of spallation.

Table 1 illustrates certain compositions encompassed by this disclosure.

TABLE 1

Arc Melted Sample Compositions

| | Ni | Co | Fe | Cr | Mn | C | Al |
|---|---|---|---|---|---|---|---|
| P118-X1 | 5 | 9.99 | 40.01 | 5 | 8 | | 32 |
| P118-X2 | 20 | 20 | 15.01 | 5 | 10 | | 30 |
| P118-X3 | 30 | 30.01 | 9.99 | 5 | 10 | | 15 |
| P118-X4 | 25.33 | 25.44 | 24.11 | 22.44 | | | 2.68 |
| P118-X5 | 23.73 | 23.83 | 22.58 | 21.03 | | | 8.84 |
| P118-X6 | 23.25 | 23.34 | 22.12 | 20.6 | | | 10.69 |
| P118-X7 | 23.24 | 36.75 | | 29.34 | | | 10.68 |
| P118-X8 | 24.18 | 38.84 | | 21.42 | | | 15.56 |
| P118-X9 | 22.71 | 45.61 | 16.21 | 5.03 | | | 10.44 |
| P118-X10 | 12.15 | 48.78 | 11.56 | 10.76 | | | 16.75 |
| P118-X11 | 22 | 21 | 20.5 | 28 | | 0.5 | 8 |
| P118-X12 | 20 | 21 | 20.2 | 30 | | 0.8 | 8 |
| P118-X13 | 20 | 21 | 20 | 30 | | 1 | 8 |
| P118-X14 | 22 | 23 | 22.5 | 26 | | 0.5 | 6 |
| P118-X15 | 20 | 21 | 24.2 | 28 | | 0.8 | 6 |
| P118-X16 | 20 | 21 | 22 | 30 | | 1 | 6 |

The disclosed alloys can incorporate the above elemental constituents to a total of 100 wt. %. In some embodiments, the alloy may include, may be limited to, or may consist essentially of the above named elements. In some embodiments, the alloy may include 2 wt. % (or about 2 wt. %) or less, 1 wt. % (or about 1 wt. %) or less, 0.5 wt. % (or about 0.5 wt. %) or less, 0.1 wt. % (or about 0.1 wt. %) or less or 0.01 wt. % (or about 0.01 wt. %) or less of impurities, or any range between any of these values. Impurities may be understood as elements or compositions that may be included in the alloys due to inclusion in the feedstock components, through introduction in the manufacturing process.

Further, the M content identified in all of the compositions described in the above paragraphs may be the balance of the composition, or alternatively, where M is provided as the balance, the balance of the composition may comprise M and other elements. In some embodiments, the balance may consist essentially of M and may include incidental impurities.

Thermodynamic Criteria

In some embodiments of this disclosure, alloys can be described fully by equilibrium or near equilibrium thermodynamic parameters. The alloys can meet some, or all, of the described thermodynamic criteria.

In typical MCrAlY alloy systems, the size of the individual phases are on the order of 5 μm-50 μm if not larger. This disclosure identifies alloys that form multiple matrix phases (a face centered cubic (FCC) metal, body centered cubic metal (BCC) metal, or an ordered structure in which two simple cubic sublattices interpenetrate each other (B2 ordered phase)) on the order of 10 nm-100 nm (or about 10 nm-about 100 nm). In a B2 ordered phase, one of the sublattices may be occupied by one element, while the other sublattice may be occupied by another element. The B2 ordered phase is distinguishable from a disordered phase, in which the sublattice positions may be occupied without or less long range order relative to the B2 ordered phase, e.g., randomly, by both elements. The B2 ordered phase can have a crystal structure such that a substantially 1:1 stoichiometry can exist between atomic species. In some of the embodiments described, one of the atomic species is aluminum (Al) and another one of the atomic species can be a transition metal such as iron (Fe), chromium (Cr), nickel (Ni), and cobalt (Co). In some embodiments, the B2 ordered phase structure is two interpenetrating BCC latices. In some embodiments, the BCC structure is entirely occupied by Al atoms and the other lattice contains a distribution of certain transition metals as described above. This fine microstructure can be defined thermodynamically by looking at two factors: 1) the compositional proximity between any two matrix phases when they form and 2) the formation temperature delta between the two phases. The compositional proximity may be determined in analyzing how similar the compositions are of two phases in an alloy. Typically, phases that have different crystal structures such as FCC and BCC have very different compositions, but not in the case of some MCrAlY alloys. The grain size of an alloy can be estimated by using the cosine similarity equation (FIG. 1) and by looking at the temperature gap between the formation of the B2 ordered phase and the next matrix phase. As described herein, B2 formation delta refers to a temperature gap between the formation temperature of the B2 ordered phase and the formation temperature of a disordered phase that is immediately adjacent to the B2 ordered phase on a temperature axis of a phase diagram. Another phase that is immediately adjacent to the B2 ordered phase on the temperature axis of the phase diagram may be any disordered metallic phase, including BCC or FCC phases. The cosine similarity considers each phase as a compositional vector. Per the equation in FIG. 1, A is the compositional vector corresponding to the composition of the B2 ordered phase and B is the compositional vector corresponding to the disordered metallic phase. Per the cosine similarity equation as Cos φ, or the proximity, approaches 1, the matrix compositions are increasingly similar.

In embodiments of the disclosure, the first and second matrix phase compositional proximity of the alloy can be 85% (or about 85%) or higher. In some embodiments, the first and second matrix phase compositional proximity of the alloy can be 90%, or about 90%, or higher. In some embodiments, the first and second matrix phase compositional proximity of the alloy can be 95%, or about 95%, or higher.

In some embodiments, the B2 Formation Delta can have a range of 0 K to 150 K (or about 0 K to about 150 K). In some embodiments, the B2 formation delta has a range of 25 K to 80 K (or about 25 K to about 80 K).

In some embodiments, the B2 ordered phase can comprise 40% (or about 40%) or greater of the total microstructure at 1300 K. In some embodiments, the B2 ordered phase can comprise 45% (or about 45%) or greater of the total microstructure at 1300 K. In some embodiments, the B2 ordered phase can comprise 50% (or about 50%) or greater of the total microstructure at 1300 K.

Sometimes hardphases such as carbides, borides and nitrides can be introduced to the alloy via mechanical blending for the purpose of increased wear resistance. In some embodiments, the formation of in-situ phases are precipitated on a fine scale during the atomization process. In some embodiments, the phases are more oxidation resistant than the metal itself which includes but is not limited to carbides, borides, nitrides, intermetallics, oxides, and silicides. Without limitation, oxidation resistance can be measured, e.g., by measuring an increase in the weight of a sample being studied (because of oxygen uptake by the metal), or a weight loss after removal of the oxide from the surface of the sample.

In some embodiments, the total mole fraction of oxidation resistant phases that form at 1300 K can be 5% (or about 5%) or greater. In some embodiments, the total mole fraction of oxidation resistant phases that form at 1300K can be 10% (or about 10%) or greater. In some embodiments, the total mole fraction of oxidation resistant phases that form at 1300 K can be 15% (or about 15%) or greater. In some embodiments, the total mole fraction of oxidation resistant phases that form at 1300 K can be 20% (or about 20%) or greater. In some embodiments, these oxidation resistant phases can include carbides, e.g., chromium carbides. For example, the oxidation resistant phases can include $M_7C_3$ or $M_{23}C_6$ carbides.

In some embodiments, mole % or mole fraction can describe an amount of atoms in the material share a characteristic. As a non-limiting example, if 40% of the atoms of a material are of a particular phase, the mole % of that phase is 40%. Mole % is a typical unit used in modeling, e.g., Calphad modeling. Calphad modeling is a phenomenological approach for calculating thermodynamic and kinetic properties of multicomponent materials systems.

In some embodiments, the alloy can have a total mole fraction of oxidation resistant phases that form at 1300 K of 5% (or about 5%) or greater and additionally the first and second matrix phase compositional proximity can be 85% (or about 85%) or higher. In such embodiments, the microstructure can combine both a fine scale structure and oxidation resistant precipitates. The following Table 2 illustrates certain measured thermodynamic criteria.

TABLE 2

| Thermodynamics | | | | |
|---|---|---|---|---|
| | 1300 Total Oxidation Resistant Phases | B2 Formation Delta K | B2 @ 1300 K | 1 + 2 Prox Wt % |
| P118-X1 | | 1735 | 100 | 1 |
| P118-X2 | | 640 | 100 | 97.4 |
| P118-X3 | | 1135 | 100 | 96.9 |
| P118-X4 | | — | 0 | 95.1 |
| P118-X5 | | 45 | 57.2 | 99.2 |
| P118-X6 | | 80 | 73.9 | 97.3 |
| P118-X7 | | 55 | 71.2 | 99.6 |
| P118-X8 | | 350 | 95 | 99.6 |
| P118-X9 | | 65 | 72.6 | 99 |
| P118-X10 | | 1105 | 100 | 99.9 |
| P118-X11 | 10 | 60 | 50.5 | 89.6 |
| P118-X12 | 15.9 | 70 | 51.7 | 90.5 |
| P118-X13 | 19.8 | 75 | 51.7 | 93.5 |
| P118-X14 | 9.9 | 5 | 34.1 | 94.7 |
| P118-X15 | 16 | 25 | 35.2 | 96.5 |
| P118-X16 | 20 | 25 | 35.7 | 95.8 |

Microstructural Criteria

In some embodiments, alloys can be described by their microstructural characteristics. The alloys can meet some, or all, of the described microstructural criteria.

In some embodiments, alloys form multiple matrix phases (a FCC metal, BCC metal, or B2 ordered phase) on the order of 10 nm-100 nm (or about 10 nm-about 100 nm), discussed below as fine scale phases. In some embodiments, this fine microstructure is seen in samples produced via arc melting which can have a cooling rate of approximately 5-20 degrees Celsius per second.

In some embodiments, the fine scale phases can make up 85% (or about 85%) or greater of the matrix. In some embodiments, the fine scale phases can make up 90% (or about 90%) or greater of the matrix. In some embodiments, the fine scale phases can make up 95% (or about 95%) or greater of the matrix.

In some embodiments, the B2 ordered phase can comprise 40% (or about 40%) or greater of the total microstructure. In some embodiments, the B2 ordered phase can comprise 45% (or about 45%) or greater of the total microstructure. In some embodiments, the B2 ordered phase can comprise 50% (or about 50%) or greater of the total microstructure.

In some embodiments, the total volume fraction of oxidation resistant phases can be 5% (or about 5%) or greater. In some embodiments, the total volume fraction of oxidation resistant phases can be 10% (or about 10%) or greater. In some embodiments, the total volume fraction of oxidation resistant phases can be 15% (or about 15%) or greater. In some embodiments, the total volume fraction of oxidation resistant phases can be 20% (or about 20%) or greater.

In some embodiments, oxidation resistant phases can be chromium carbides. In some embodiments, the oxidation resistant phases can be $M_7C_3$ or $M_{23}C_6$ carbides.

In some embodiments, the total volume fraction of oxidation resistant phases can be 5% (or about 5%) or greater while also maintaining a matrix consisting of 85% (or about 85%) or greater fraction of fine scale phases. In such embodiments, the microstructure will combine both a fine scale structure and oxidation resistant precipitates.

Performance

The performance of MCrAlY bond coats can be characterized by their Furnace Cycle Testing (FCT) results. Samples of the MCrAlY with a TBC topcoat are subjected to 60 min in the furnace at a predetermined temperature (1150° C. typically) and then removed and air quenched for 10 min to complete a single cycle. Samples are determined to have failed when the TBC has spalled or broken, typically due to overgrowth of the TGO and results are reported in cycles to failure.

In some embodiments, the alloy shows an improved cycle lifetime of 30% or more compared to Diamalloy® 4700 during FCT testing at 1150° C. In some embodiments, the alloy shows an improved cycle lifetime of 35% or more compared to Diamalloy® 4700 during FCT testing at 1150° C. In some embodiments, the alloy shows an improved cycle lifetime of 40% or more compared to Diamalloy® 4700 during FCT testing at 1150° C.

For example, Diamalloy® 4700 exhibits 235 cycles before failure. In some embodiments, the disclosed alloys can exhibit>270 cycles before failure. In some embodiments, the disclosed alloys can exhibit>300 cycles before failure. In some embodiments, the disclosed alloys can exhibit>330 cycles before failure. In some embodiments, the disclose alloys can exhibit>340 cycles before failure.

EXAMPLES

In some embodiments, an alloy containing a fine microstructure is described. For this case, P118-X5 can be used as an example and compared to a typical MCrAlY named Diamalloy® 4700.

Figure 3:
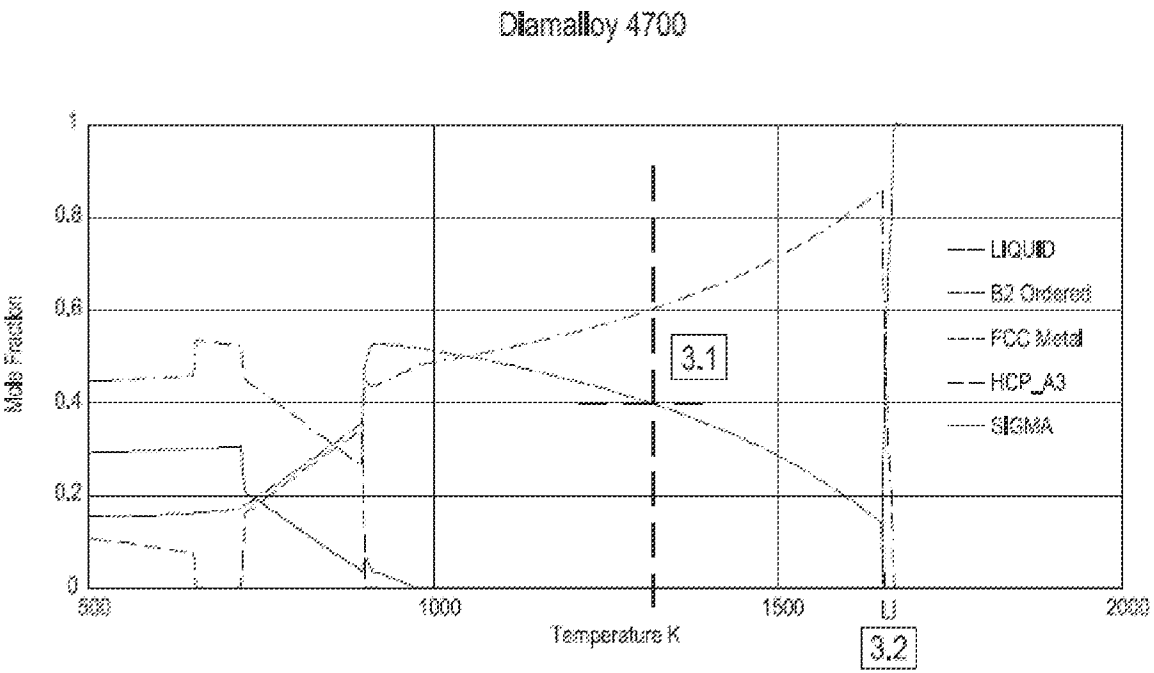
FIG. 3 illustrates an embodiment of a phase diagram for Diamalloy® 4700.

First, the thermodynamic properties of the two alloys can be compared. P118-X5 and Diamalloy® 4700 have a B2 order phase fraction at 1300 K of 57.2% (2.1 of FIG. 2) and 40.7% (3.1 of FIG. 3) and compositional matrix phase proximities that are fairly similar to one another at values of 99.2% and 97.1% respectively. The key difference is that the B2 formation delta for P118-X5 is 45K (2.2 of FIG. 2) whereas the B2 ordered phase forms second in Diamalloy® 4700 and thus has a B2 formation delta of −10K (3.2 of FIG. 3). Thus, P118-X5 forms a fine scale microstructure but Diamalloy® 4700 does not.

Figure 4:
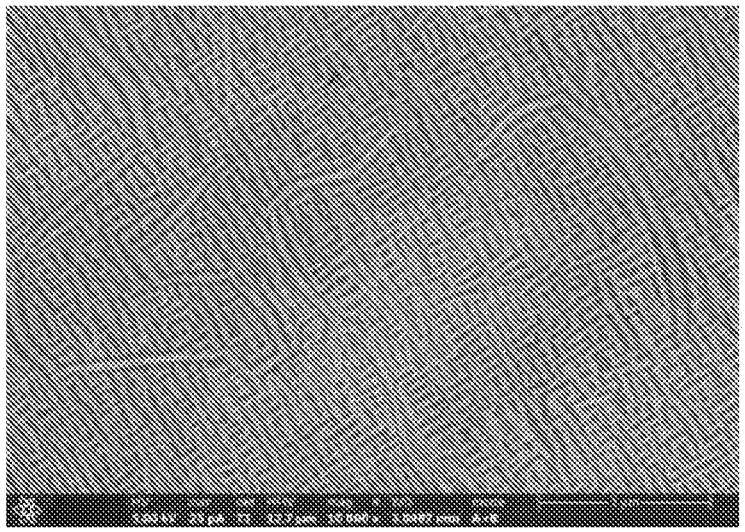
FIG. 4 illustrates an SEM micrograph of P118-X5 at 2kX magnification.
Figure 5:
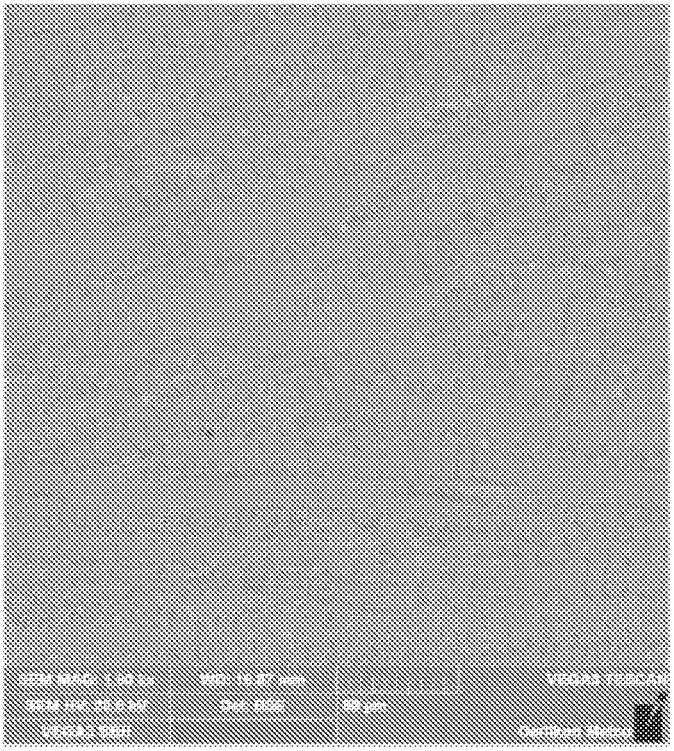
FIG. 5 illustrates an SEM micrograph of Diamalloy® 4700 at 1kX magnification.

The analysis of the microstructures for each alloy confirms what the thermodynamics predicts, P118-X5 forms a fine microstructure whereas Diamalloy® 4700 does not. As seen in FIG. 4, the microstructure of P118-X5 contains the matrix phases of B2 ordered, BCC metal and FCC metal that are all within the range of 10 nm-100 nm resulting in a 100% fine scale microstructure. Diamalloy® 4700 on the other hand forms a FCC metal matrix with B2 phases forming in a lamellar fashion resulting in phases that are much coarser and in the range of 5 m to 50 m as shown in FIG. 5.

Lastly, the performance of the alloys can be compared to one another. P118-X5 saw an improvement in cycle lifetime of approximately 43% over Diamalloy® 4700.

In some embodiments, a MCrAlY type alloy is described that forms a fine scale microstructure while also precipitating oxidation resistant phases. P118-X11 can be used as an example to describe this embodiment thermodynamically and microstructurally.

Figure 6:
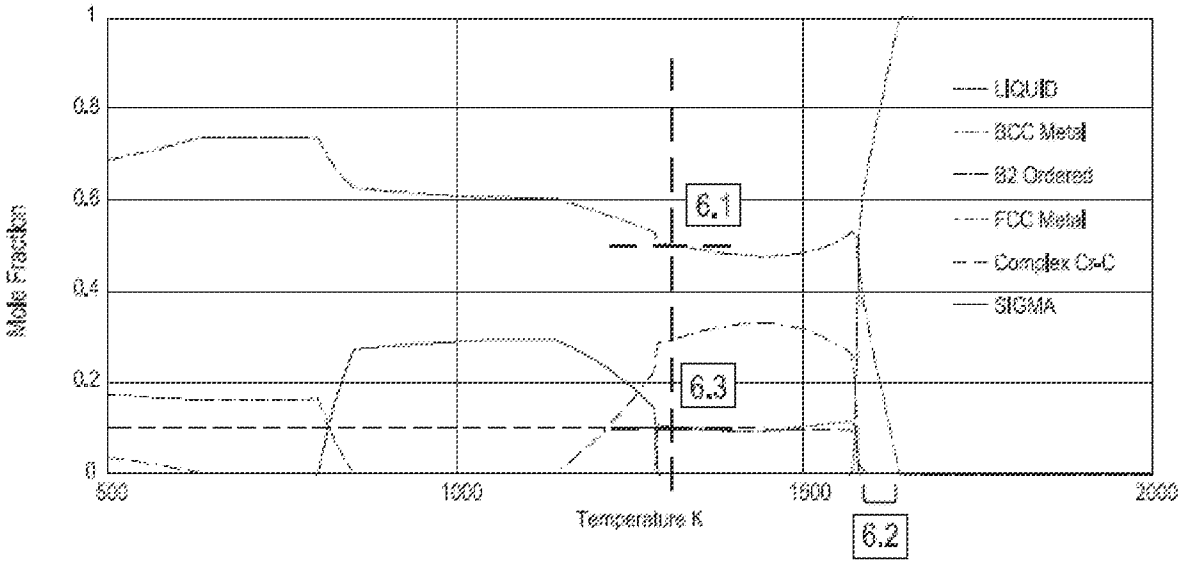
FIG. 6 illustrates an embodiment of a phase diagram for P118-X11.

FIG. 6 is the phase diagram for P118-X11. Here the B2 fraction at 1300K is 50.5% (6.1), the B2 formation delta is 60K (6.2) and the compositional proximity is measured to 89.6%, which indicates that this alloy will likely form a fine scale microstructure. In addition to these criteria, P118-X11 forms $M_7C_3$ type complex chromium carbides which are characterized as an oxidation resistant phase. The total mole fraction of oxidation resistant phases for P118-X11 at 1300K is roughly 10% (6.3).

Figure 7:
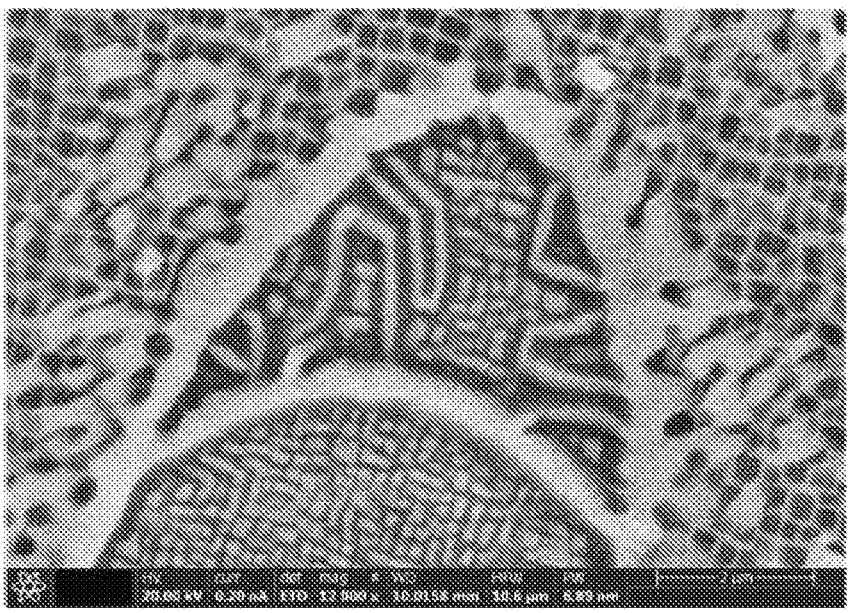
FIG. 7 illustrates an SEM micrograph of P118-X11 at 12kX magnification.
Figure 8:
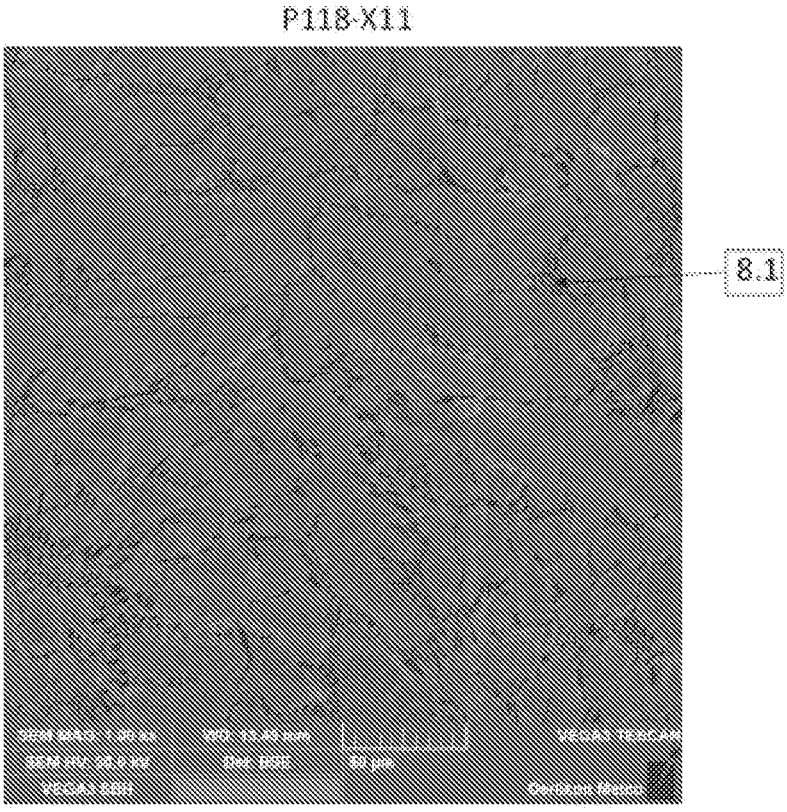
FIG. 8 illustrates an SEM micrograph of P118-X11 at 1kX magnification.

Next, a microstructural analysis took place on an arc melted sample of P118-X11 and to see if a fine microstructure was formed in the matrix. As FIG. 7 shows, the matrix consists of a fine microstructure of B2 ordered and BCC metal phases with sizes in the range of 10 nm-100 nm. Additionally in FIG. 8, it is shown that approximately 10% volume fraction of coarser complex chromium carbides precipitate as the oxidation resistant phase (8.1). The favorable oxidation behavior at 1150° C. associated with $Cr_7C_3$ precipitates in the microstructure is not intuitive as $Cr_7C_3$ alone is known to decompose at temperatures of around 1000° C.

In further experiments P118-X5 was again compared against typical McrAlY compositions commercially known as Diamalloy® 4700 (nominally in wt. % Ni-32 Co-38-5 Cr-21 Al-8 Y-0.5), and Amdry®386 (nominally in wt. % Ni 47.6 Co-22 Cr-17 Al-12 Y-0.5 Si-0.4 Hf-0.5). The coatings were sprayed onto a Hastelloy X substrate with a MCrAlY thickness of 300 μm followed by a top layer of a standard 7 yttria stabilized zirconia thermal barrier coating. The resultant coating was then heat treated in a vacuum at 1080° C. for 4 hrs. Finally, the coatings were tested in standard furnace cycling testing (FCT) whereby 1150° C. was the high temperature portion of the cycle and the coatings were in a fan cooled room temperature environment at the low temperature portion of the cycle.

The P118-X6 alloy had an FCT lifetime of 374 cycles with a standard deviation of 51 cycles. The P118-X6 had an 18.7% increased cycle lifetime over Diamalloy® 4700 and P118-X6 additionally had more consistent performance: 51 cycle standard deviation in P118-X6 vs. 131 cycle standard deviation for Diamalloy® 4700. The P118-X6 had a 44% increased cycle lifetime over Amdry® 386.

Another inherent benefit of the P118-X6 is the reduction in cobalt and nickel content of the alloy in comparison to Diamllay® 4700, Amdry® 386 and the typical portfolio of MCrAlY compositions used by industry today. In some embodiments the combined nickel and cobalt content is below 60 wt. %, in preferred embodiments the combined nickel and cobalt content is below 55 wt. % In some embodiments, the combined nickel and cobalt content is below 50 wt. %.

Another benefit of the P118-X6 composition is the ability to achieve good performance without the use of expensive rare earth additions. Rare earth elements most commonly used in MCrAlY alloys include ytrrium. rhenium, hafnium, and tantalum. In some embodiments, the rare earth content is at or below 2 wt. %. In some embodiments, the rare earth content is at or below 1 wt. %, In some still preferred embodiments, the rare earth content is at or below 0.5 wt. %. In some embodiments, no rare earth elements are used other than yttrium Applications for Use MCrAlY alloys as described above can be used in a variety of applications and industries. Some non-limiting examples of applications of use include:

Upstream oil and gas applications include the following components and coatings for the following components: process vessels and coating for process vessels including steam generation equipment, amine vessels, distillation towers, cyclones, catalytic crackers, general refinery piping, corrosion under insulation protection, sulfur recovery units, convection hoods, sour stripper lines, scrubbers, hydrocarbon drums, and other refinery equipment and vessels.

Power generation applications include the following components and coatings for the following components: boiler tubes, precipitators, fireboxes, turbines, generators, cooling towers, condensers, chutes and troughs, augers, bag houses, ducts, ID fans, coal piping, and other power generation components.

Steel applications include the following components and coatings for the following components: cold rolling mills, hot rolling mills, wire rod mills, galvanizing lines, continue pickling lines, continuous casting rolls and other steel mill rolls, and other steel applications.

Aerospace applications include the following components and coatings for the following components: bond coats for thermal barrier coatings and/or environmental barrier coatings, material constituents for abradables coatings, and general coatings for oxidation resistance.

The alloys described in this patent can be produced and or deposited in a variety of techniques effectively. Some non-limiting examples of processes include:

Thermal spray process including those using a wire feedstock such as twin wire arc, spray, high velocity arc spray, combustion spray and those using a powder feedstock such as high velocity oxygen fuel, high velocity air spray, plasma spray including atmospheric and vacuum, detonation gun spray, and cold spray. Wire feedstock can be in the form of a metal core wire, solid wire, or flux core wire. Powder feedstock can be either a single homogenous alloy or a combination of multiple alloy powder which result in the desired chemistry when melted together.

Welding processes including those using a wire feedstock including but not limited to metal inert gas (MIG) welding, tungsten inert gas (TIG) welding, arc welding, submerged arc welding, open arc welding, bulk welding, laser cladding, and those using a powder feedstock including but not limited to laser cladding, ultra-high speed lasers cladding (EHLA), and plasma transferred arc welding. Wire feedstock can be in the form of a metal core wire, solid wire, or flux core wire. Powder feedstock can be either a single homogenous alloy or a combination of multiple alloy powder which result in the desired chemistry when melted together.

Post processing techniques including but not limited to rolling, forging, surface treatments such as carburizing, nitriding, carbonitriding, heat treatments including but not limited to austenitizing, normalizing, annealing, stress relieving, tempering, aging, quenching, cryogenic treatments, flame hardening, induction hardening, differential hardening, case hardening, decarburization, machining, grinding, cold working, work hardening, and welding.

From the foregoing description, it will be appreciated that inventive products and approaches for bond coat alloys are disclosed. While several components, techniques and aspects have been described with a certain degree of particularity, it is manifest that many changes can be made in the specific designs, constructions and methodology herein above described without departing from the spirit and scope of this disclosure.

Certain features that are described in this disclosure in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations, one or more features from a claimed combination can, in some cases, be excised from the combination, and the combination may be claimed as any sub-combination or variation of any sub-combination.

Moreover, while methods may be depicted in the drawings or described in the specification in a particular order, such methods need not be performed in the particular order shown or in sequential order, and that all methods need not be performed, to achieve desirable results. Other methods that are not depicted or described can be incorporated in the example methods and processes. For example, one or more additional methods can be performed before, after, simultaneously, or between any of the described methods. Further, the methods may be rearranged or reordered in other implementations. Also, the separation of various system components in the implementations described above should not be understood as requiring such separation in all implementations, and it should be understood that the described components and systems can generally be integrated together in a single product or packaged into multiple products. Additionally, other implementations are within the scope of this disclosure.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than or equal to 10% of, within less than or equal to 5% of, within less than or equal to 1% of, within less than or equal to 0.1% of, and within less than or equal to 0.01% of the stated amount. If the stated amount is 0 (e.g., none, having no), the above recited ranges can be specific ranges, and not within a particular % of the value. For example, within less than or equal to 10 wt./vol. % of, within less than or equal to 5 wt./vol. % of, within less than or equal to 1 wt./vol. % of, within less than or equal to 0.1 wt./vol. % of, and within less than or equal to 0.01 wt./vol. % of the stated amount.

Some embodiments have been described in connection with the accompanying drawings. The figures are drawn to scale, but such scale should not be limiting, since dimensions and proportions other than what are shown are contemplated and are within the scope of the disclosed inventions. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

While a number of embodiments and variations thereof have been described in detail, other modifications and methods of using the same will be apparent to those of skill in the art. Accordingly, it should be understood that various applications, modifications, materials, and substitutions can be made of equivalents without departing from the unique and inventive disclosure herein or the scope of the claims.

What is claimed is:

1. A feedstock material, comprising:

a composition that comprises, in weight percent (wt. %):
nickel: 18-31;
cobalt: 18-31;
iron: 18-31;
chromium: 16-27; and
aluminum: 2-13; and a microstructure that comprises a B2 ordered phase and a disordered metallic phase, wherein the disordered metallic phase comprises a BCC crystal structure or an FCC crystal structure, wherein, under equilibrium conditions, a formation temperature of the B2 ordered phase is greater than a formation temperature of the disordered metallic phase by between 0 K and 150 K, and wherein at least 85% of grains in the microstructure have a size of 100 nm or smaller.

2. The feedstock material of claim 1, wherein the composition further comprises 0.25-1 wt. % yttrium.

3. The feedstock material of claim 1, wherein the formation temperature of the B2 ordered phase is greater than the formation temperature of the disordered metallic phase by between 25 K and 80 K under equilibrium thermodynamic conditions.

4. The feedstock material of claim 1, wherein the microstructure comprises 40 mole % or more of the B2 ordered phase under thermodynamic equilibrium conditions.

5. The feedstock material of claim 1, wherein the microstructure further comprises 5 mole % or greater of one or more oxidation resistant phases under thermodynamic equilibrium conditions, wherein the one or more oxidation resistant phases include a compound of a metal that has higher oxidation resistance compared to the metal and wherein the one or more oxidation resistant phases comprises chromium carbide.

6. A coating comprising:

a composition that comprises, in weight percent (wt. %):
nickel: 18-31;
cobalt: 18-31;
iron: 18-31;
chromium: 16-27; and
aluminum: 2-13; and a microstructure that comprises a B2 ordered phase and a disordered metallic phase, wherein:

the disordered metallic phase comprises a BCC crystal structure or an FCC crystal structure, under equilibrium conditions, a formation temperature of the B2 ordered phase is greater than a formation temperature of the disordered metallic phase by less than 150 K, and at least 85% of grains in the microstructure have a size of 100 nm or smaller when the coating is formed by cooling from a liquid state at a rate between 5° C./sec and 20° C./sec.

7. The coating of claim 6, wherein the microstructure comprises at least 40 mole % of the B2 ordered phase.

8. The coating of claim 6, wherein the microstructure further comprises 5 volume % or greater of one or more oxidation resistant phases, wherein the one or more oxidation resistant phases include a compound of a metal that has higher oxidation resistance compared to the metal and wherein the one or more oxidation resistant phases comprises chromium carbide.

9. The coating of claim 6, wherein the coating is formed on a Ni-based superalloy.

10. The coating of claim 6, wherein the coating has applied thereon a thermal barrier coating.

11. The coating of claim 10, wherein the thermal barrier coating comprises yttria-stabilized zirconia.

12. The coating of claim 6, wherein the composition further comprises 0.25-1 wt. % yttrium.

13. A bond coat material comprising:

M, Cr, and Al, wherein M is one or more of Ni, Co, and Fe; and a microstructure that comprises a B2 ordered phase and a disordered metallic phase, wherein the disordered metallic phase comprises a BCC or FCC crystal structure, wherein, under equilibrium conditions, a formation temperature of the B2 ordered phase is greater than a formation temperature of the disordered metallic phase by between 0 K and 150 K, and wherein at least 85% of grains in the microstructure are 100 nm in size or smaller when solidified from a liquid state at a rate between 5° C./second and 20° C./second.

14. The bond coat material of claim 13, wherein the B2 ordered phase and the disordered metallic phase have a cosine similarity of greater than 85%.

15. The bond coat material of claim 13, wherein the B2 ordered phase comprises greater than 40 mole % of the microstructure.

16. The bond coat material of claim 13, wherein the microstructure further comprises 10 mole % or greater of one or more oxidation resistant phases, wherein the one or more oxidation resistant phases include a compound of a metal that has higher oxidation resistance compared to the metal and wherein the one or more oxidation resistant phases comprises chromium carbide.

17. The bond coat material of claim 13, wherein the bond coat material comprises in weight % (wt.%):

nickel: 18-31;
cobalt: 18-31;

iron: 18-31;

chromium: 16-27; and aluminum: 2-13.

18. The bond coat material of claim 13, wherein, upon cooling from the liquid state during the formation of the bond coat material, the B2 ordered phase precipitates first, followed by the disordered metallic phase.

19. The bond coat material of claim 18, further comprising:

0.1-1 wt. % yttrium.

20. The bond coat material of claim 13, wherein the bond coat material is formed between a Ni-based superalloy and a thermal barrier coating.

* * * * *